United States Patent [19]

Pinkerton et al.

[11] Patent Number: 4,969,961

[45] Date of Patent: Nov. 13, 1990

[54] SM-FE-V MAGNET ALLOY AND METHOD OF MAKING SAME

[75] Inventors: Frederick E. Pinkerton, Sterling Heights; Daniel J. Van Wingerden, Warren, both of Mich.

[73] Assignee: General Motors Corporation, Detroit, Mich.

[21] Appl. No.: 318,390

[22] Filed: Mar. 3, 1989

[51] Int. Cl.[5] ..... H01F 1/04

[52] U.S. Cl. ..... 148/301; 420/83; 420/127

[58] Field of Search ..... 148/301; 420/83, 127

[56] References Cited

U.S. PATENT DOCUMENTS 4,322,257 3/1982 Menth et al. ..... 148/301

FOREIGN PATENT DOCUMENTS 55-16481 2/1980 Japan ..... 148/301

OTHER PUBLICATIONS

Buschow, "Physico-Chemical Properties of Ternary Rare Earth Base Alloys and their Relation to Permanent Magnet Applications", Paper No. W8.1 at the 9th Int'l Workshop on Rare Earth Magnets and their Application, Aug. 31–Sep. 2, 1987.

Buschow et al., "Magnetic Properties of Ternary Fe--Rich Rare Earth Intermetallic Compounds", *IEEE Transactions of Magnetics*, vol. 24, No. 2, Mar. 1988, pp. 1611–1616.

DeBoer et al., "Magnetic Properties of a Series of Novel Ternary Intermetallics ($RFe_{10}V_2$)", *Journal of the Less-Common Metals, vol. 135, 1987, pp. 199–204.*

DeMooij et al., "A New Class of Ferromagnetic Materials: $RFe_{10}V_2$", *Phillips Journal of Research*, vol. 42, No. 2, 1987, pp. 246–251.

DeMooij et al., "Some Novel Ternary $ThMn_{12}$-Type Compounds", *Journal of the Less-Common Metals*, vol. 136, 1988, pp. 207–215.

Hadjipanayis et al., "Hard Magnetic Properties of R-Fe-Ti Alloys", *Applied Physics Letters*, vol. 51, No. 24, Dec. 14, 1987, pp. 2048–2050.

Muller, "Magnetic Material R,Fe,Mo,(Co) with $ThMn_{12}$ Structure", *Journal of Applied Physics*, vol. 64, No. 1, Jul. 1, 1988, pp. 249–251.

"New Mag Material?", *Rare-Earth Information Center News*, Institute for Physical Research and Technology, Iowa State University, Ames, Iowa, vol. XXIII, No. 2, Jun. 1, 1988, pp. 1, 5.

Ohashi et al., "The Magnetic and Structural Properties of R-Ti-Fe Ternary Compounds", *IEEE Transactions on Magnetics*, vol. MAG-23, No. 5, Sep. 1987, pp. 3101–3103.

Schultz et al., "Coercivity in $ThMn_{12}$-Type Magnets", MMM-Intermag Conference 1988, Vancouver, B.C., Jul. 12–15, 1988, paper GA-02.

*Primary Examiner*—John P. Sheehan

*Attorney, Agent, or Firm*—George A. Grove

[57] ABSTRACT

A magnetically hard compound having the approximate formula $SmFe_{10}V_2$ formed by rapidly quenching a molten mixture of the precursors either with or without subsequent annealing exhibits an intrinsic room temperature coercivity of at least 5 kOe. A mixture of samarium, iron and vanadium is melted and then rapidly quenched by metal spinning to form a fine grained structure with magnetic anisotropy as quenched. Alternatively, the molten material is over-quenched and then annealed to optimize the magnetic properties of the alloy.

2 Claims, 3 Drawing Sheets

SM-FE-V MAGNET ALLOY AND METHOD OF MAKING SAME

FIELD OF THE INVENTION

This invention relates to a permanent magnet alloy and the method of making it and particularly to such an alloy having high room temperature coercivity and to a method of forming such magnetic alloys from molten iron, samarium and vanadium.

BACKGROUND OF THE INVENTION

U.S. Pat. No. 4,496,395 to Croat, assigned to the assignee of this application, discloses high coercivity rare earth-iron alloys and the method of making them by melt spinning a molten mixture of the alloy precursors. An intrinsic room temperature coercivity exceeding 5 kOe was obtained with a neodymium-iron alloy in its as-quenched condition. A samarium-iron alloy having typically about 40 atomic percent samarium was also disclosed. U.S. Pat. No. 4,802,931 to Croat, also assigned to the assignee of this application, discloses the related rare earth-iron alloy further including boron. The preferred methods of forming permanent magnets from that material include over-quenching a molten mixture of the precursors by melt spinning and then annealing to promote crystal growth to the optimum size for the desired magnetic properties; alternatively the material is direct quenched to form the desired crystal sizes. An intrinsic room temperature coercivity exceeding 15 kOe was obtained along with very high remanence and high energy product. This alloy contained about 14 atomic percent of neodymium for the rare earth element. The substitution of samarium for neodymium was considered but only an intrinsic room temperature coercivity of 1,800 was achieved.

The work of Croat, discussed above, stimulated many researchers to study ternary rare earth-iron alloys in an attempt to find other useful permanent magnet materials. Compounds having the tetragonal $ThMn_{12}$ structure have been identified as promising candidates. These compounds have the form $REFe_{12-x}T_x$ where RE is a rare earth, T Si, Ti, V, Cr, Mo or W and typically x=2. The use of samarium for the rare earth has been determined to be of particular interest and coercivities of up to 2.5 kOe have been reported for melt-spun $Sm_8Fe_{84}Ti_8$ and up to 3.8 kOe for mechanically alloyed $Sm_{12}Fe_{80}Mo_{10}$. Thus a myriad of possible compounds and processing methods present themselves. Only a few, if any, of the possible combinations are likely to be useful permanent magnet materials.

SUMMARY OF THE INVENTION

It is therefore an object of the invention to provide a particular compound of the form $REFe_{12-x}T_x$ and especially such a compound containing samarium and vanadium which is magnetically hardened to exhibit an intrinsic room temperature coercivity of at least 5 kOe. Specifically, it is an object to provide such a compound having the approximate formula $SmFe_{10}V_2$ formed by rapidly quenching a molten mixture of the precursors either with or without subsequent annealing to achieve the desired magnetic properties. Another object of the invention is to provide a process for making a permanent magnet alloy from a mixture of samarium, iron and vanadium and particularly to such a method including melting the mixture and then rapidly quenching it followed, in some cases, by heat treating to optimize the magnetic properties of the alloy.

The invention is carried out by a method of making an alloy with permanent magnetic properties at room temperature comprising the steps of: forming a mixture of samarium, iron and vanadium, melting the mixture to form a homogeneous alloy, and quenching the alloy at a rate such that it solidifies substantially instantaneously to form an alloy potentially having an inherent room temperature magnetic coercivity of at least about 5 kOe. Preferably, the alloy comprises 70 to 80 atomic percent iron and consits essentially of the phase $SmFe_{10}V_2$. This method comprehends achieving the high coercivity as-quenched or alternatively over-quenching the material and then annealing it.

The invention is further carried out by a permanent magnet having an inherent intrinsic magnetic coercivity of at least 5 kOe at room temperature comprising a rapidly quenched alloy of iron, vanadium, and samarium.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE PREFERRED EMBODIMENT

Figure 1:
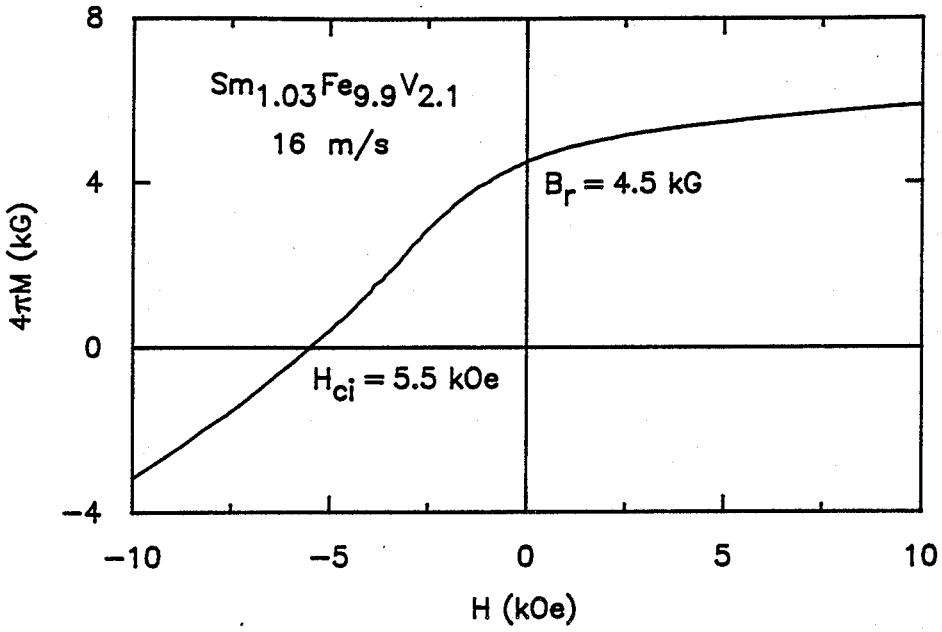
FIG. 1 is a demagnetization curve for an as-quenched sample of the alloy prepared according to one embodiment of the invention.

The following description of the invention is directed to the Sm-Fe-V alloys and the magnetic hardening of the alloys by melt-spinning to obtain a material having a predominant phase of the tetragonal $ThMn_{12}$ structure, specifically $SmFe_{10}V_2$. The melt-spinning process basically involves melting the desired materials in a quartz crucible, ejecting a stream of molten material under pressure through an orifice in the crucible onto a spinning disc which affords a chill surface for instantaneous quenching. The material solidifies as a thin ribbon which is thrown off the disc. The thickness of the ribbon and thus the quenching rate can be varied by changing the disc velocity. The whole procedure is carried out in an inert gas atmosphere. The melt spinning process and apparatus is more completely explained in the aforementioned U.S. Pat. No. 4,496,395 which is incorporated herein by reference. That patent is particularly directed to the "as-quenched" process while the "over-quenching and annealing" process is fully described in the U.S. Pat. No. 4,803,931 which is also incorporated herein by reference.

Still another process that can be used with the Sm-Fe-V material is the orient-press-sinter (OPS) method wherein the melt-spun material is ground to a fine powder having particle sizes of a few microns, pressed into a body while in an aligning magnetic field, and then sintered in a furnace to yield a magnetized material. The magnetic properties of the resulting material have not been established.

Samarium has a low melting temperature (1077° C.) and high vapor pressure, while vanadium has a high melting temperature (1890° C.). This can cause loss of Sm by vaporization during both the alloying and the melt spinning. In practice, procedures were adopted to minimize the losses and compensate for losses of samarium by vaporization during the melting of the mixture. First, the Fe and V were pre-alloyed by arc-melting stoichiometric quantities of the elements to obtain an $Fe_{10}V_2$ ingot having a lower melting temperature (about 1480° C.). This greatly reduced the temperature to which the samarium was exposed. The Sm was then added to the alloy by melting the Sm and the pre-alloy in a boron nitride crucible by induction heating. Up to 20% excess Sm was incorporated into the alloy in order to compensate for the vaporization of Sm during both the alloying and melt spinning steps. The following examples illustrate the practice of our invention.

EXAMPLE 1

A quantity bf pre-alloy of Fe and V was placed in a crucible along with a quantity of Sm to give a nominal stoichiometry of $Sm_{1.2}Fe_{10}V_2$. The materials were melted and ejected from the crucible at 1430° C. through an orifice of 0.029 inch diameter using an ejection pressure of 4 psig. The material was ejected onto the surface of a chrome plated copper quenching wheel. The final composition of the ribbons according to electron microprobe analysis was $Sm_{1.03}Fe_{9.9}V_{2.1}$. The quench rate was varied by changing the surface velocity of the wheel. Room temperature demagnetization curves on crushed ribbon samples were obtained using a vibrating sample magnetometer with applied fields of up to 19 kOe. The best as-quenched magnetic properties were obtained at a wheel surface velocity of 16 m/s.

Figure 2:
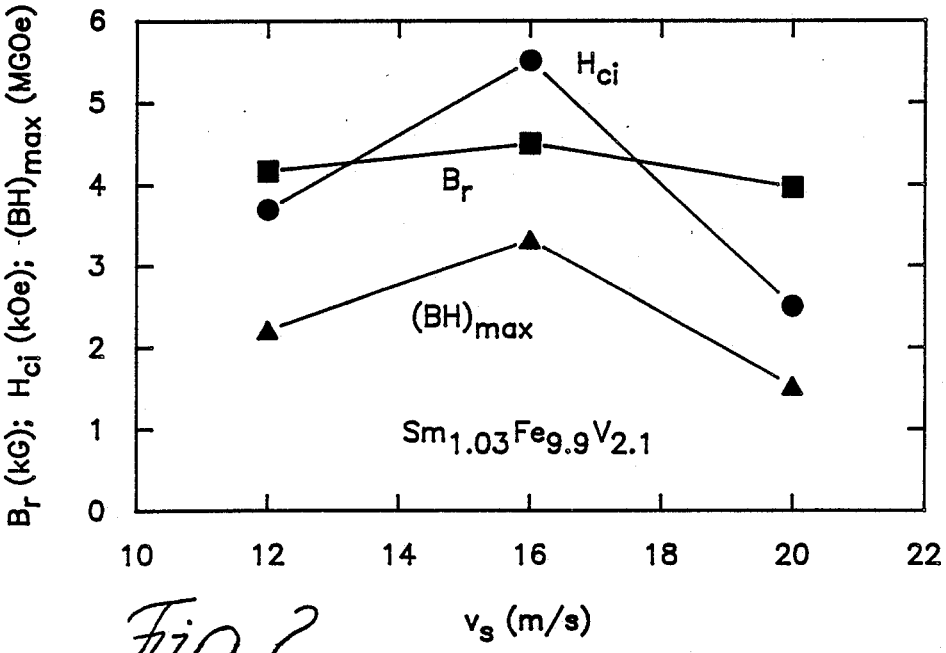
FIG. 2 is a graph of magnetic properties induced at various quench rates of a Sm-Fe-V alloy.

FIG. 1 shows the demagnetization curve for an as-quenched sample melt-spun at a substrate velocity of 16 m/s. This optimally quenched ribbon has an intrinsic coercivity $H_{ci}=5.5$ kOe and remanence $B_r=4.5$ kG. FIG. 2 shows the coercivity, remanence and energy product for the samples melt spun at 12, 16 and 20 m/s. The properties vary significantly with substrate speed but all reach their maximum at 16 m/s. X-ray powder diffraction analysis of the sample confirms that the pattern can be indexed to the $ThMn_{12}$. structure, indicating that the ribbon is almost entirely comprised of $SmFe_{10}V_2$. The Curie temperature of the ribbon is 585K as determined by differential scanning calorimetry.

EXAMPLE 2

Figure 3:
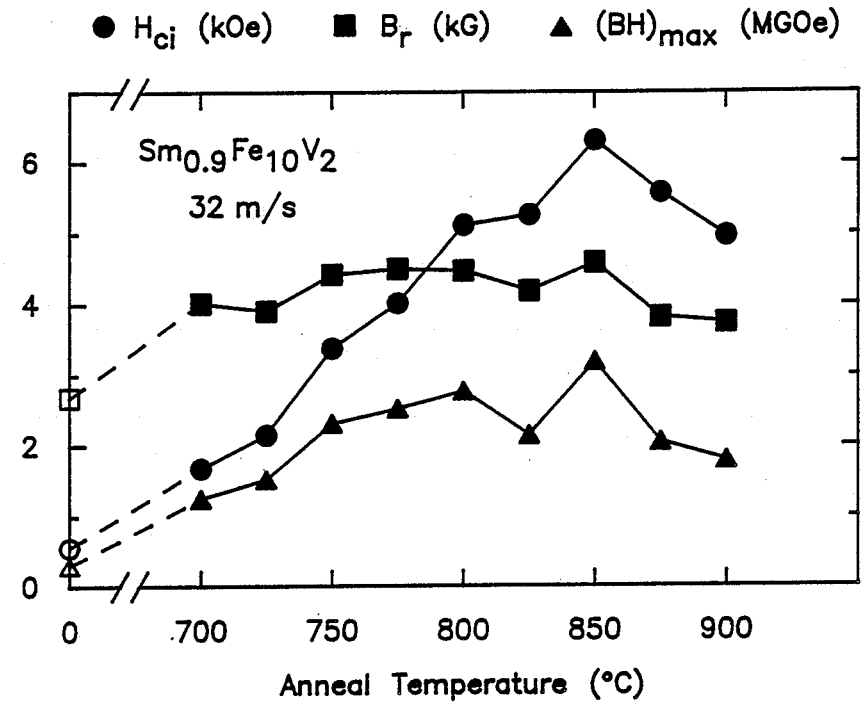
FIG. 3 is a graph of magnetic properties induced at various annealing temperatures in an over-quenched Sm-Fe-V alloy sample, according to a second embodiment of the invention.

High coercivity is also obtained by quenching the ribbon into an amorphous or very finely microcrystalline state and subsequent annealing. A molten mixture prepared essentially as in Example 1 and having a starting composition of $Sm_{1.08}Fe_{10}V_2$ was over-quenched by ejecting onto a quenching wheel having a substrate velocity of 32 m/s. The resultant composition was analyzed to be $Sm_{0.9}Fe_{10}V_2$. Samples from the ribbon were annealed at several different temperatures and the magnetic properties measured for each sample as shown in FIG. 3. The open symbols at the left side of FIG. 3 indicate the magnetic properties for the unannealed alloy. The optimum properties, especially intrinsic coercivity, were obtained at a maximum anneal temperature of 850° C. Annealing is accomplished by holding the sample in a vial in an oven with the sample temperature monitored by a thermocouple. When a desired temperature has been reached the vial is removed from the oven and allowed to cool slowly. As indicated in FIG. 3 the properties vary dramatically with anneal temperature, such that variances from 850° C. by only 50° C. or less decrease the properties. It thus appears that a useful range of about 800° C. to 900° C. can be used as a maximum annealing temperature.

Figure 4:
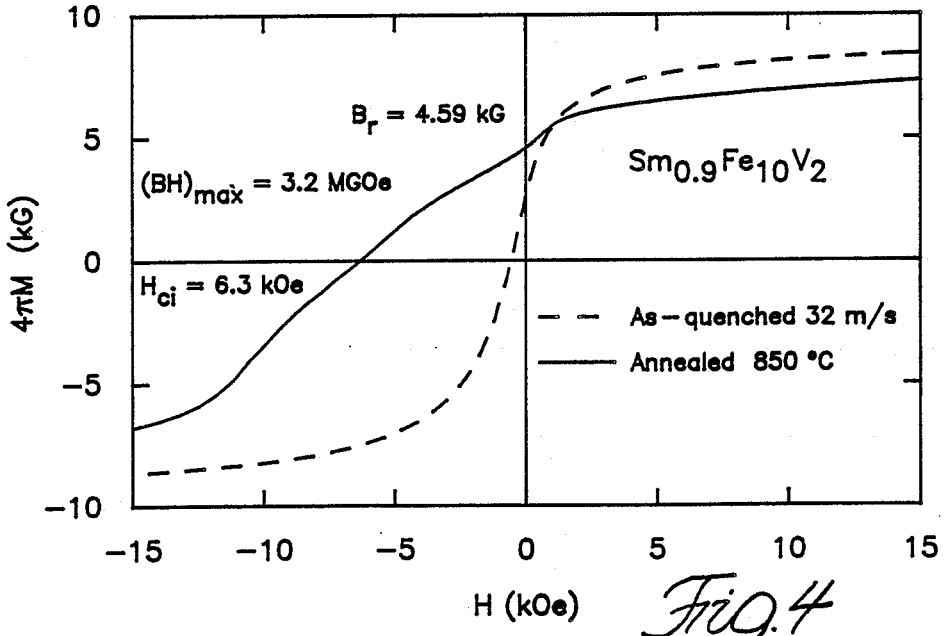
FIG. 4 is a demagnetization curve for an over-quenched and optimally annealed sample of the alloy prepared according to the second embodiment of the invention.

FIG. 4 shows a demagnetization curve (full line) for the sample annealed to 850° C. and a curve for the as-quenched sample (dashed line). The annealed sample has a remanence of 4.59 kG and intrinsic coercivity of 6.3 kOe. The energy product is 3.2 MGOe. Grain sizes not greater than 100 to 200 nanometers diameter were measured from a scanning electron micrograph.

EXAMPLE 3

Figure 5:
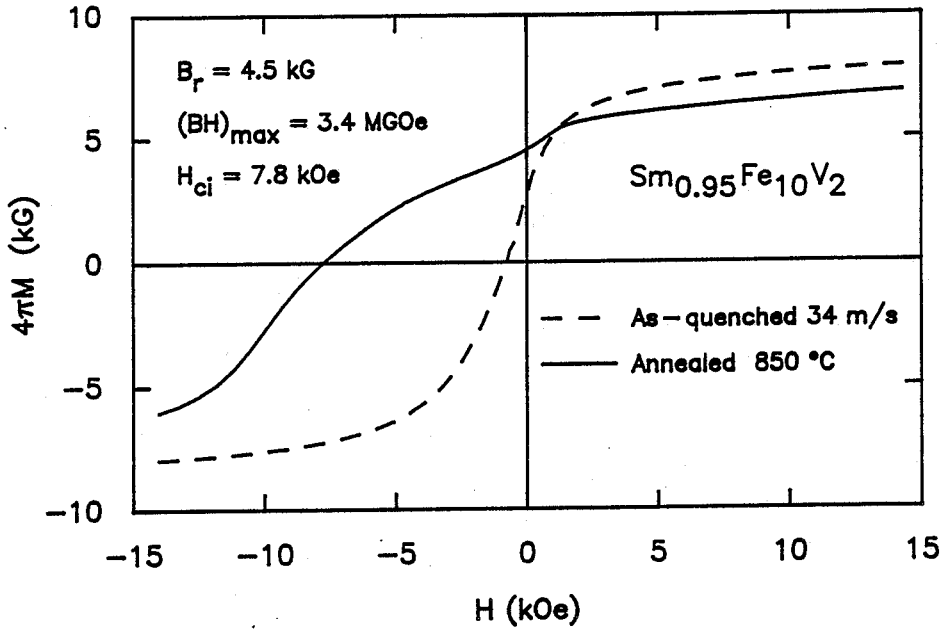
FIG. 5 is a demagnetization curve for another over-quenched and optimally annealed sample of the alloy prepared according to the second embodiment of the invention.

A molten mixture prepared essentially as in Example 1 and having a starting composition of $Sm_{1.03}Fe_{10}V_2$ was over-quenched by ejecting onto a quenching wheel having a substrate velocity of 34 m/s. The resultant composition was analyzed to be $Sm_{0.95}Fe_{10}V_2$. FIG. 5 shows a demagnetization curve (full line) for the sample annealed to 850° C. and a curve for the as-quenched sample (dashed line). The annealed sample has a remanence of 4.5 kG and intrinsic coercivity of 7.8 kOe. The energy product is 3.4 MGOe.

EXAMPLE 4

Figure 6:
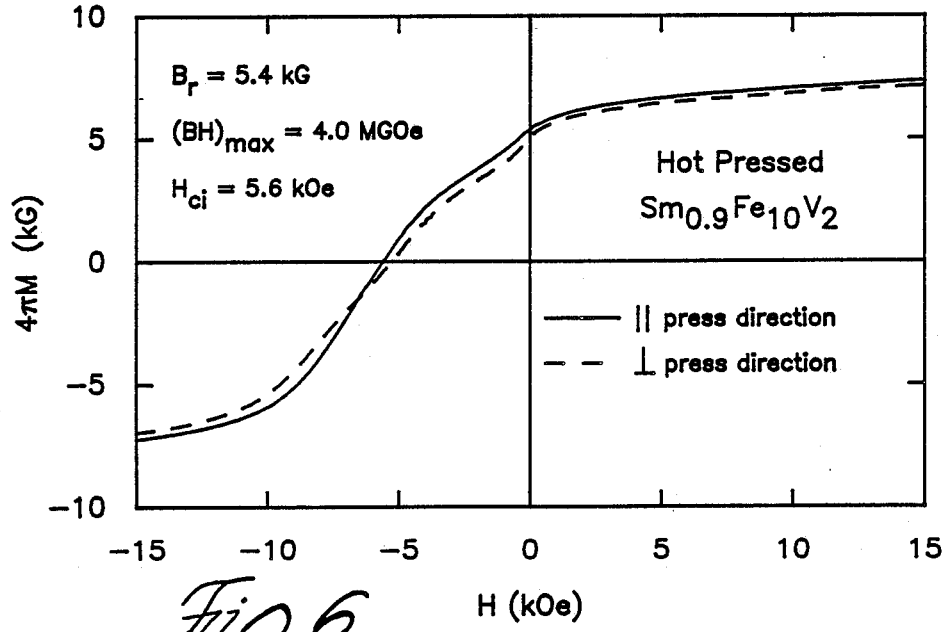
FIG. 6 is a demagnetization curve for an over-quenched and hot pressed sample of the alloy prepared according to the third embodiment of the invention.

A sample prepared and quenched as in Example 2 was hot pressed for 12 minutes at 825° C. and a pressure of 25 kpsi to form a sample having a density of 7.62 $g/cm^3$ which is 98% of its theoretical x-ray density. As shown in the demagnetization curves of FIG. 6 representing magnetic properties in the direction of pressing (full line) and perpendicular to the press direction (dashed line), there is a slight anisotropy induced during densification. The bulk magnetic properties are intrinsic coercivity of 5.6 kOe, remanence of 5.4 kG and energy product of 4 MGOe.

Thus we have discovered an alloy which when magnetically hardened in a particular way has significant magnetic properties, and we have also discovered the particular methods for hardening the Sm-Fe-V ternary compound.

The embodiments of the invention in which an exclusive property or privilege is claimed are defined as follows:

1. A permanent magnet alloy having an intrinsic magnetic coercivity of at least 5,000 Oersteds at room temperature comprising 70 to 80 atomic percent iron and consisting essentially of the tetragonal crystal phase $SmFe_{10}V_2$, the grain size of said alloy being no greater than 200 nm.

2. A magnetically hard alloy having an intrinsic room temperature coercivity of at least 5,000 Oersteds, said alloy consisting essentially of a predominant phase of $SmFe_{10}V_2$ in the form of grains of a size no greater than 200 nm.

* * * * *